US008201545B2

(12) United States Patent
Soueidan

(10) Patent No.: US 8,201,545 B2
(45) Date of Patent: Jun. 19, 2012

(54) PAINTBALL MARKER

(75) Inventor: Ahmed Soueidan, Columbia, IL (US)

(73) Assignee: Ahmed Soueidan, Columbia, IL (US)

( * ) Notice: Subject to any disclaimer, the term of this patent is extended or adjusted under 35 U.S.C. 154(b) by 45 days.

(21) Appl. No.: 12/882,287

(22) Filed: Sep. 15, 2010

(65) Prior Publication Data

US 2012/0060813 A1 Mar. 15, 2012

(51) Int. Cl.
*F41B 11/00* (2006.01)

(52) U.S. Cl. ..... 124/74

(58) Field of Classification Search ..... 124/51.1, 124/53.5, 74
See application file for complete search history.

(56) References Cited

U.S. PATENT DOCUMENTS 7,594,503 B2 9/2009 DeHaan et al.
7,607,424 B2 * 10/2009 Monks ..... 124/77
7,735,479 B1 6/2010 Quinn et al.
7,770,570 B2 * 8/2010 Lian ..... 124/72
2008/0041353 A1 * 2/2008 Gan ..... 124/63
2008/0257327 A1 * 10/2008 Monks ..... 124/48
2009/0235909 A1 * 9/2009 Lian ..... 124/51.1
2010/0275894 A1 * 11/2010 Kaakkola et al. ..... 124/73
2011/0083654 A1 * 4/2011 Galinson ..... 124/59

* cited by examiner

*Primary Examiner* — Troy Chambers
(74) *Attorney, Agent, or Firm* — Harness, Dickey & Pierce, P.L.C.

(57) ABSTRACT

A paintball marker includes a housing having formed therein a cylindrical chamber with an axis and an open end, and a valve assembly within and coaxial with the chamber. The chamber wall has first and second openings. The valve assembly is configured so that, during one period of revolution about the axis, in a first portion the valve assembly closes the second opening while permitting entry of a ball into the chamber through the first opening, and in a second portion the valve assembly closes the first opening while permitting entry of compressed gas into the chamber through the second opening. The compressed gas entering the chamber during the second portion expels the ball through the open end of the chamber. Delivery of the ball to the housing, and delivery of compressed gas to expel the ball, requires only one moving part, namely the valve assembly revolving in the chamber.

20 Claims, 10 Drawing Sheets

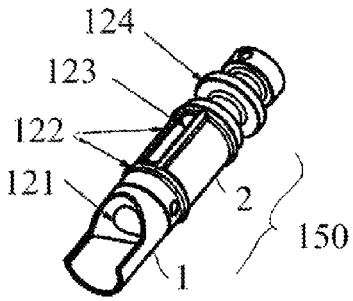
Fig. 4A
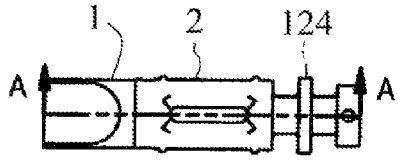
Fig. 4B
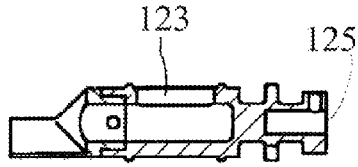
Fig. 4C
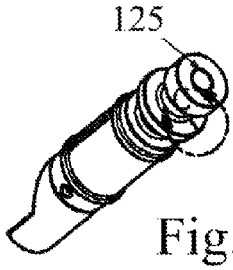
Fig. 4D
Fig. 4E
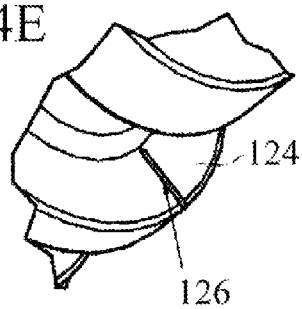

PAINTBALL MARKER

FIELD OF THE DISCLOSURE

This disclosure relates to the recreational sport of paintball, and more particularly to a paintball marker device.

BACKGROUND OF THE DISCLOSURE

Paintball and Paintball Markers:

Paintball markers are used in the sport and recreation of paintball to engage in strategic field tactics against opposing players. Similar to the game of tag, this action pursuit game is generally played as two opposing teams seek to eliminate rival players with paint marks. Each participant (paintball player) uses a paintball marker to precisely fire a paintball projectile intended to burst on the target, leaving a distinct paint mark. Paintball markers propel a paintball projectile, typically a round gelatin-filled ball with non-toxic, washable paint, at a sufficient muzzle velocity so that its capsule breaks on impact within range.

Most paintball markers operate with the assistance of air, nitrogen, or carbon dioxide. Because of the energy generated as these gases exceed atmospheric pressure, compressed gases are commonly used to propel a paintball projectile out the firing chamber and through the barrel of paintball markers. These gases are commonly stored inside the paintball marker apparatus with adequate pressure to achieve the desired muzzle velocity and proper functional operation when fired. The stored energy in the compressed gas is thus transferred to the paintball projectile when the paintball marker fires the projectile; the supply of projectiles and compressed gas is depleted during operation of the paintball marker.

Changes in paintball marker technology have shaped the development of the sport itself. Improvements in paintball markers' speed, accuracy, air efficiency, reliability, ergonomics, aesthetics, and audibility have helped to popularize the sport. Avid paintball players continuously research new and improved paintball marker designs.

Paintball Marker Selection Criteria:

Paintball players may consider numerous technical and aesthetic criteria when selecting a paintball marker, including the following:

Speed (rate of fire): The speed of a paintball marker is measured in paintballs fired per second; 15-20 balls per second is a typical speed.

Firing modes: Semi-automatic, 3-burst, full-automatic, and other firing modes are available.

Accuracy: Several factors influence the accuracy of a paintball marker. It is desirable to minimize recoil, for improved overall accuracy and firing stability (or shooting platform). High "ball on ball" precision (the measure of the radial region of paintball splats on the target) is desired; ideally paintballs strike ahead of one another on a target. Precise muzzle velocity is also desired; ideally the muzzle velocity (measured by a chronograph) has an instrument reading of +/−2 feet per second. "Drop-off" (decrease in muzzle velocity at higher rates of fire or during an initial discharge) should be kept to a minimum or avoided all together.

Air efficiency: Air efficiency is measured by the number of shots that can be discharged with a full tank of compressed gas. Less consumption of compressed gas per shot allows the player to stay longer on the playing field without having to refill the compressed gas tank.

Reliability: "Chopping" and ball breakage must be avoided. Chopping refers to breaking paintballs in the breech before they are discharged from the breech to the barrel. Ball breakage is a general term for breaking paintballs inside the paintball marker before they exit the barrel. Breaking paintballs may ruin the on-field experience and may contribute to a forfeit.

Operation and maintenance: It is desirable to have working parts made of durable materials. Fewer working parts contributes to longer life and ease of routine maintenance (lubricating moving parts, seals, etc.). Generally a more simple operation is easier to fix or troubleshoot. The method of operation of the paintball marker may contribute to the likelihood of a breakdown or malfunction.

Ergonomics: A lighter weight paintball marker allows the user to quickly reengage opponents. "Snap-shooting" is a popular skill used on the field; this firing technique involves a quick shot before hiding behind cover, and is easier with a lightweight paintball marker. Generally a compact design of paintball marker is desired. The smaller the target size, the more likely a player will stay in the game and not be eliminated. Weight and size both contribute to overall firing technique and player endurance.

Aesthetics: It is desirable to have a variety of colors, shapes, milling designs, etc. for different components of the paintball marker. Players often wish to customize their paintball markers by selecting from a variety of compatible parts.

Audibility: Quiet operation is desirable because noise coming from the paintball marker can give away a position to an opponent. Also, a player can better communicate if there is reduced noise interruption from the marker.

Types of Paintball Markers

There are two types of paintball markers: markers with hammers, and markers without hammers.

Markers with hammers: These paintball marker designs typically use a hammer to thrust open a poppet sealed air valve held shut by a spring. A bolt, typically attached to the hammer, is responsible for loading and sealing the firing chamber while routing the compressed gas from the open valve to propel the paintball. The bolt and hammer reciprocate forward and backwards once while firing a single shot. In some markers, the hammer is driven electronically via an air solenoid, or mechanically via a sear and spring. Air solenoids operate with a dwell time, or the length of time the air valve can be opened. Most air solenoids can achieve a minimum of 6 ms (milliseconds) dwell time.

Markers without hammers: These paintball markers use a "spool" with an array of O-rings to seal and contain gas pressure in a plurality of chambers. As the spool is moved or shifted forward, the compressed gas is redirected into new passageways and released to fire a paintball. Similar to markers with hammers, spool markers use a bolt-style design to load and fire a paintball. These operate mechanically or electronically with the assist of an electronic valve or air solenoid.

Markers with air solenoids also require a low pressure regulator (LPR) to regulate the pressure to operate the air solenoid. If there is any variation in the pressure regulation from the LPR to the air solenoid, the paintball marker may discharge a paintball inaccurately. Specifically, relying on a LPR to regulate the air solenoid and open the valve may cause inconstant firing velocity, or low precision (poor "ball on ball" accuracy). Furthermore, markers with LPR and air solenoids are prone to drop-off.

Conventional Paintball Markers:

Conventional paintball markers, particularly those with LPRs and air solenoids, have several drawbacks that can frustrate the player and disrupt the on-field experience, in particular:

Accuracy: High recoil due to impact and movement from multiple moving parts. Parts reciprocate back and forth. Paintball is moving when fired.

Air Efficiency: Commonly, compressed gas is used to operate the firing mechanism and to propel the paintball. Most markers used assisted valves or air solenoids to linkage their overall firing mechanism. Traditional ones use "blowback" (or a surge of compressed air or CO2 to reset or "recock" their mechanism. Some air solenoids have a minimum dwell time (length of time the air solenoid can throttle open the valve). Compressed air may be wasted due to an excessive dwell time. The ideal dwell time is 3.33 ms which cannot be achieved with conventional air solenoids used for paintball markers. Also, pressurized gas is depleted due to the effect of the "off" (the return travel of the valve link) mechanism on these linear reciprocating valves. Due to the limitations on air efficiency, larger compressed air tanks may be required.

Reliability: Complex mode of operation, with multiple moving parts requiring lubrication; numerous O-rings, springs, and fasteners. Paintball marker can chop or break paintballs from their loading mechanisms (bolts reciprocate forwards to load a paintball into its firing position and can break them while doing so). Air solenoids may permanently fail if the input pressure spikes above its maximum pressure rating. Air solenoids have low maximum pressure ratings and are therefore prone to failure.

Ergonomics: Number and complexity of working parts causes excess weight. Size is driven by the need to house the multiple working parts.

Maintenance: Many different replacement components need to be purchased, e.g. air solenoids, valves, low pressure regulators, hoses, O-rings, air bolts, bolt pins, hammers, springs, etc.

Audibility: Number and complexity of working parts causes excess noise during operation.

Two recently issued patents further serve to illustrate features of conventional paintball markers. U.S. Pat. No. 7,735,479 to Quinn et al. discloses a paintball marker having a bolt, an impact ring within the bolt, and a striking surface contacted by the impact ring. U.S. Pat. No. 7,594,503 to DeHaan et al. discloses a paintball marker with a bolt and an air solenoid requiring a low-pressure regulator.

Desirable Improvements:

It is desirable to implement a lightweight, compact, durable paintball marker having a minimum number of moving parts and that does not use a LPR linked to an air solenoid, and accordingly may offer improved accuracy, firing precision, air efficiency, reliability and ergonomics when compared to currently available paintball markers.

SUMMARY OF THE DISCLOSURE

The present disclosure provides a paintball marker including a housing having formed therein a cylindrical chamber with an axis and an open end, and a valve assembly within and coaxial with the chamber. The chamber wall has first and second openings. The valve assembly is configured so that, during one period of revolution about the axis, in a first portion the valve assembly closes the second opening while permitting entry of a ball into the chamber through the first opening, and in a second portion the valve assembly closes the first opening while permitting entry of compressed gas into the chamber through the second opening. The compressed gas entering the chamber during the second portion expels the ball through the open end of the chamber.

In an embodiment, the valve assembly includes a valve body and a scoop. The valve body has an axial slot therein for permitting entry of the compressed gas in the second portion of the period; the slot has sides extending in the axial direction and ends extending in the azimuthal direction. The valve body has protrusions at an exterior cylindrical surface thereof for contacting an inner surface of the chamber and thereby preventing escape of the compressed gas at the exterior of the valve; the protrusions form axially spaced circumferential seals at respective ends of the slot and longitudinal or face seal(s) along respective sides of the slot. In this embodiment, the valve assembly further comprises a scoop for holding the ball; the scoop is attached to the valve body and coaxial therewith, and is configured to receive the ball entering the chamber in the first portion of the period and to close the first opening in the second portion of the period. The scoop is open at a front end thereof to permit movement of the ball as it is expelled, and has an opening at a rear end thereof communicating with an interior of the valve body, so that the compressed gas flows through that opening toward the ball in the second portion of the period.

It will be appreciated that delivery of the ball to the housing, and delivery of compressed gas to expel the ball, requires only a single moving part, namely the valve assembly revolving in the chamber.

The foregoing has outlined, rather broadly, the preferred features of the present disclosure so that those skilled in the art may better understand the detailed description of the disclosure that follows. Additional features of the disclosure will be described hereinafter that form the subject of the claims of the disclosure. Those skilled in the art should appreciate that they can readily use the disclosed conception and specific embodiment as a basis for designing or modifying other structures for carrying out the same purposes of the present disclosure and that such other structures do not depart from the spirit and scope of the disclosure in its broadest form.

BRIEF DESCRIPTION OF THE DRAWINGS

FIGS. 4A-4D are respectively a front perspective view, a top view, a cross section view, and a rear perspective view of a revolving valve assembly according to an embodiment of the disclosure, including a front revolving chamber scoop and a rear revolving valve.

FIG. 4E is a detail view of FIG. 4D, showing the home position marked on a sensor disc of the revolving valve assembly.

FIG. 8 illustrates an O-ring design used to seal gas pressure for the revolving valve assembly. Three O-rings attach externally to features 600, 601, & 602. 600 is the gland for the "face" seal provided to seal gas pressure around the slot. 601 & 602 are the glands for the azimuthal seals provided to contain air pressure at all times during operation.

DETAILED DESCRIPTION

Figure 1A:
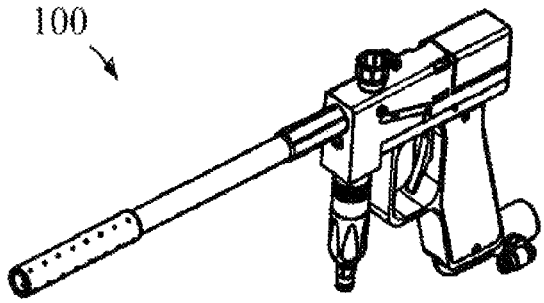
FIGS. 1A-1C are respectively a front perspective view, a side view, and a rear perspective view of a paintball marker according to an embodiment of the disclosure.
Figure 1B:
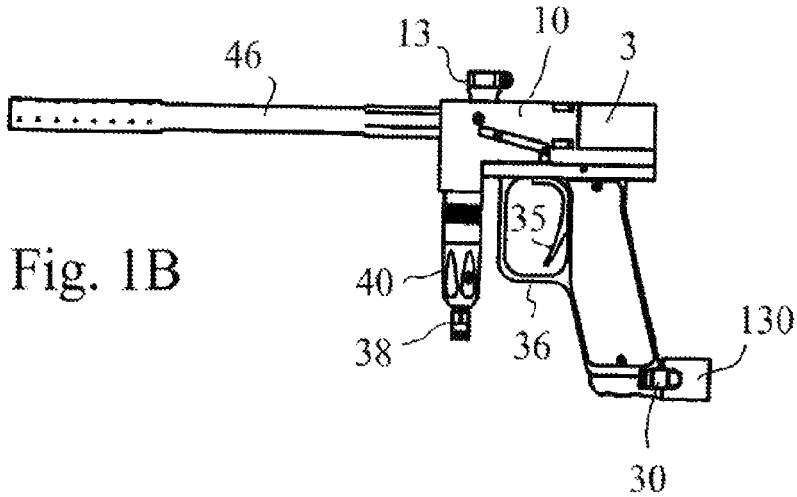
Figure 1C:
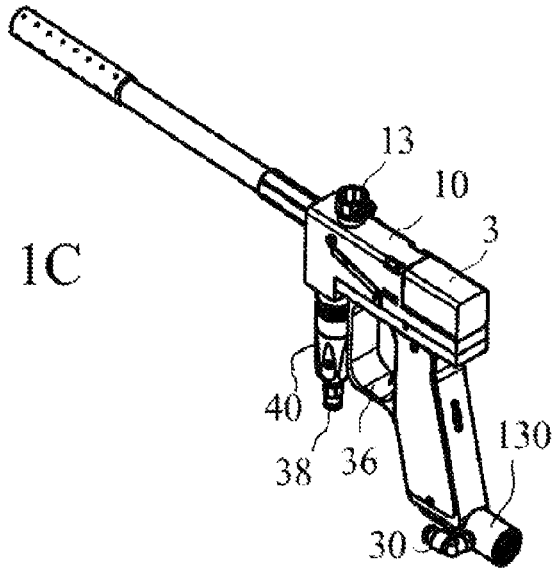

A paintball marker 100 in accordance with the disclosure is shown in three separate views in FIGS. 1A, 1B and 1C. Marker 100 has a main housing 10, into which is inserted a revolving valve assembly, discussed in detail below. The revolving valve assembly is driven by a motor 3 at the rear of the main housing. Paintballs are fed by gravity or agitation from a hopper (not shown) through feedneck 13 and into a breech portion of the main housing. Compressed gas from a tank (not shown), coupled to the marker at gas coupler 130, is fed through 90° air swivel connector 30, forward through a gas tube (not shown) and into air source adapter (ASA) regulator 40 through straight air connector 38. Compressed gas fills a reservoir in housing 10. The player holds the handle (integral with trigger guard 36) and squeezes the trigger 35 to discharge one or more paintballs. The revolving valve assembly is driven so that compressed gas from the reservoir meets the paintball inside the main housing; the paintball is discharged through barrel 46.

Figure 2:
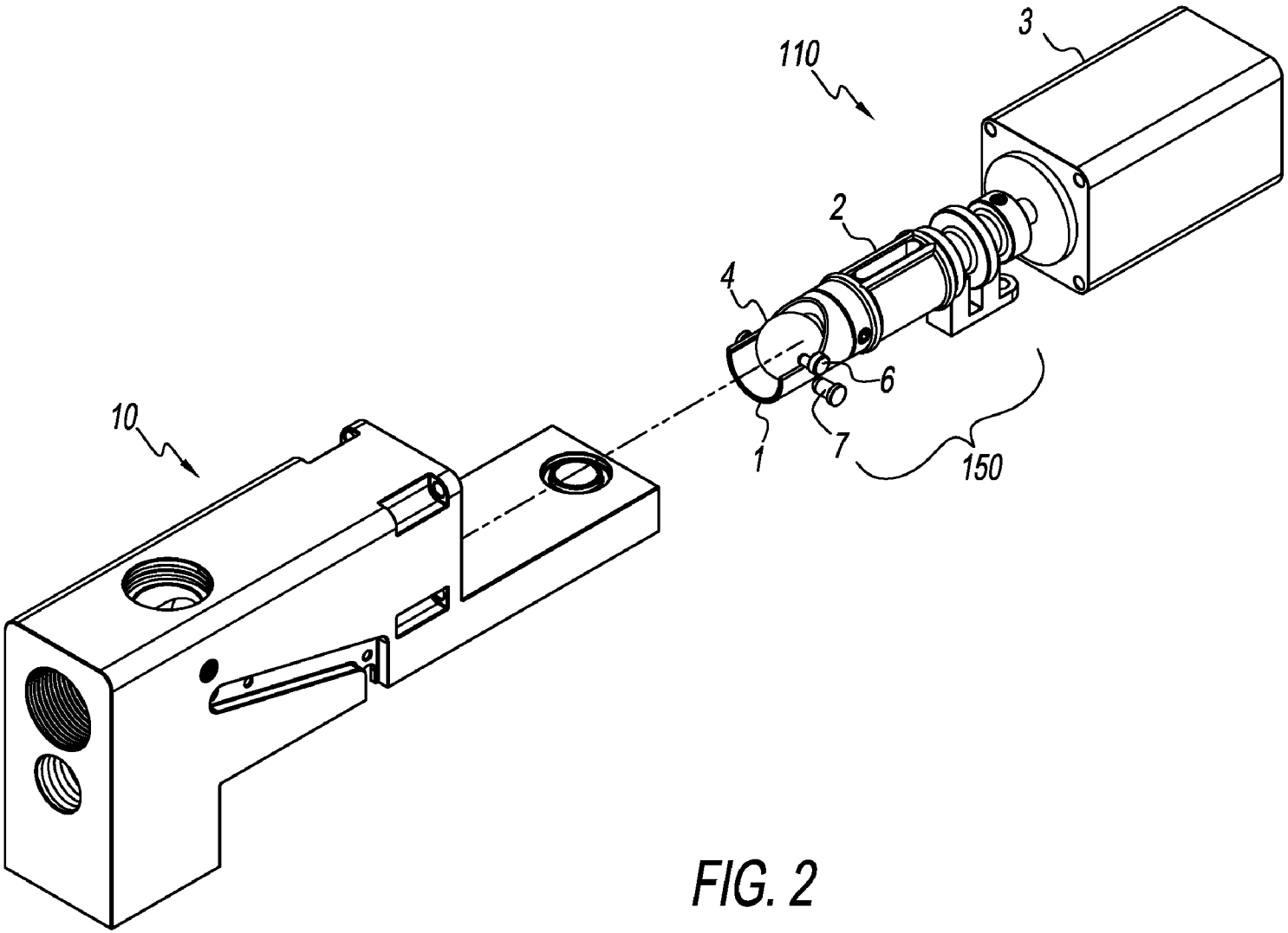
FIG. 2 illustrates a main housing and a revolving valve assembly with a motor, in a paintball marker according to an embodiment of the disclosure.
Figure 3A:
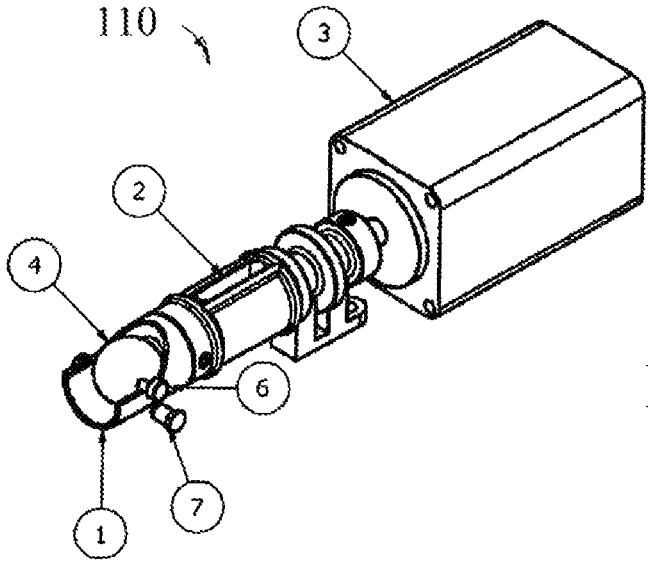
FIGS. 3A-3C are respectively a front perspective view, a rear perspective view, and a disassembled view of the revolving valve assembly and motor of FIG. 2.
Figure 5A:
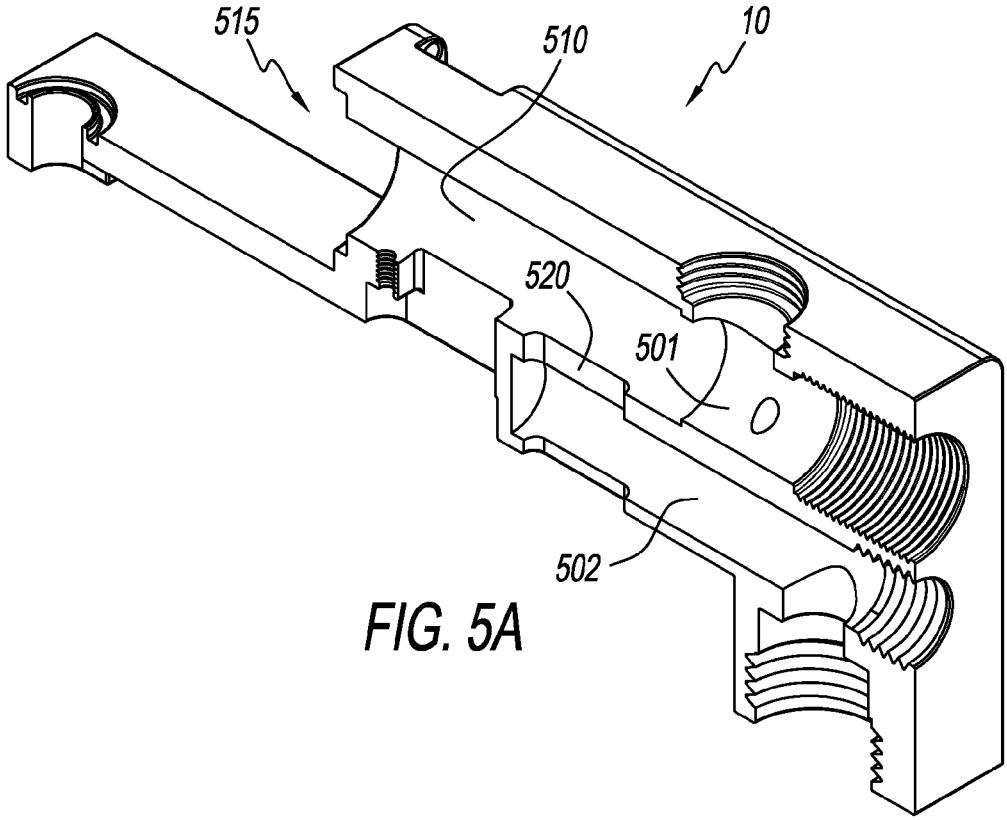
FIGS. 5A and 5B are respectively a cutaway view and a cross section view of the main housing of a paintball marker according to an embodiment of the disclosure.
Figure 5B:
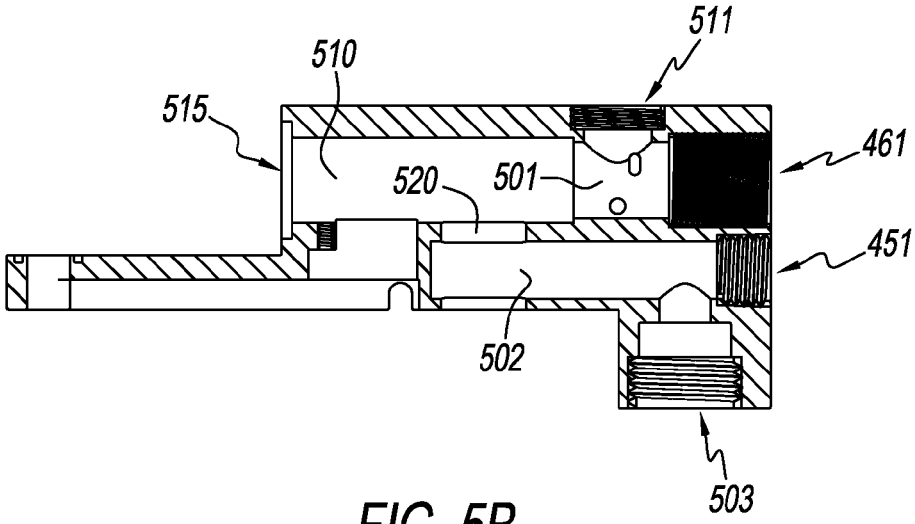

As shown in FIG. 2, the combination 110 of motor and valve assembly mates with main housing 10 at the rear thereof, so that valve assembly 150 is received in a cylindrical bore in the main housing (see also FIGS. 5A and 5B). Motor 3 connects to the rear of revolving valve assembly 150. Combination 110, which includes the motor and the revolving valve assembly, is shown in three separate views in FIGS. 3A, 3B and 3C. In FIG. 3A, the revolving valve assembly is shown holding a paintball 4.

Revolving Valve Assembly:

Components of the revolving valve assembly 150 will now be described, with reference to FIGS. 3A-3C and 4A-4E. This assembly includes front revolving chamber scoop 1 and rear revolving valve 2. Front revolving chamber scoop 1 is shaped so that it holds the paintball at rest prior to the paintball being propelled through the barrel. Chamber scoop 1 is made of transparent material (e.g. acrylic or polycarbonate) to permit the electronic breakbeam eyes (described more fully below) to function. The scoop is located directly beneath feedneck 13, so that as the paintball 4 feeds itself into the breech portion of the main housing 10, the paintball 4 lands directly in the scoop 1 and remains in the chamber scoop until the paintball is discharged. Scoop 1 has an air exit hole 121 opening to the rear of the scoop along the axis of the valve assembly; compressed gas is discharged through this hole to propel the paintball through the barrel. In operation, the scoop revolves while the paintball is discharged, thereby closing the breech as compressed gas is discharged from the air exit hole. The scoop is sized according to the caliber of the paintball (.68 or .50 calibers are common). Scoop 1 is attached to rear revolving valve 2 by chamber screws 9 (see FIG. 3C).

Rear revolving valve 2 can be constructed of ball-bearing grade materials. These ultra-slick materials have an extremely low friction coefficient, which decreases with an increase of external force applied, and are frequently used in dynamic sealing applications. As illustrated in FIGS. 3A-3C and 4A, the body of valve 2 is cylindrical, has air entrance slot 123 formed therein and has round seals 122 protruding slightly from the cylindrical surface. Air entrance slot 123 extends along the axis of the cylinder and typically is relatively narrow in the direction perpendicular to the axis (that is, the azimuthal direction). In this embodiment, the angular width of air entrance slot 123 is 30°. The round seals 122 trap compressed gas in a reservoir while the revolving valve is at rest. The round seals comprise two circumferential seals (that is, following the circumference of the cylinder in the azimuthal direction), axially spaced from each other at either end of air entrance slot 123, and two longitudinal seals (parallel to the axis and sometimes comprising of a surface, or face, seal containing air entrance slot 123) on either side of the air entrance slot 123. The two longitudinal seals (and in some instances a face seal) prevent compressed gas from escaping to the air entrance slot when the valve is at rest and while the valve is in motion, except during a portion of the period of its revolution (the dwell time, as explained below) when the air entrance slot is open to the compressed gas reservoir. The two circumferential seals (on both ends of air entrance slot 123) keep compressed gas sealed at all times, both while the valve is at rest and while the valve is in motion.

Figure 10A:
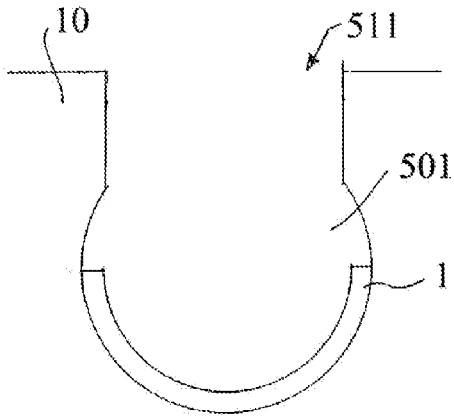
FIG. 10A illustrates in cross section view the home position of the front revolving chamber scoop relative to the breech opening in the main housing of FIGS. 5A and 5B.
Figure 10B:
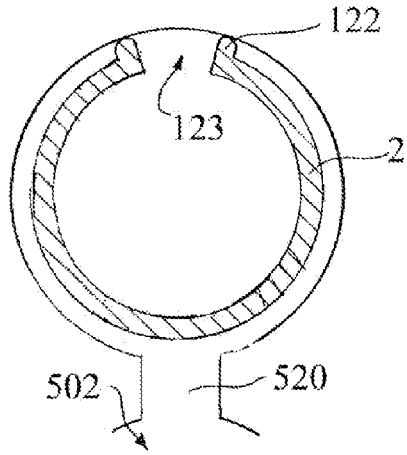
FIG. 10B illustrates in cross section view the home position of the rear revolving valve relative to the compressed gas slot in the main housing of FIGS. 5A and 5B.
Figure 10C:
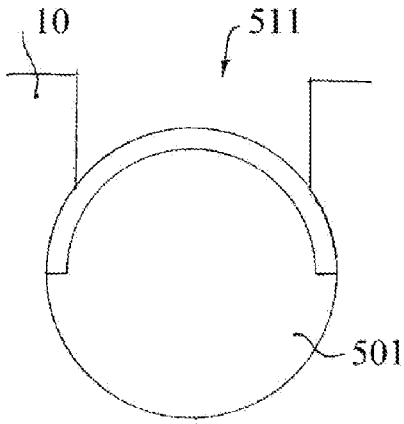
FIG. 10C illustrates in cross section view the position of the front revolving chamber half a revolution from the home position, relative to the breech opening in the main housing of FIGS. 5A and 5B.
Figure 10D:
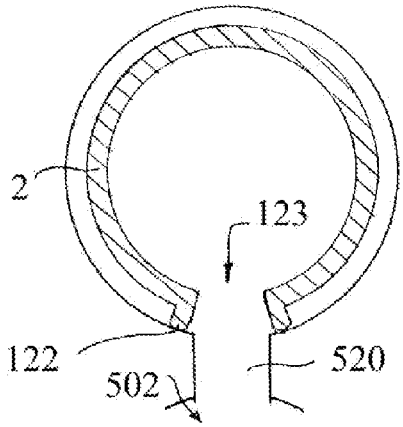
FIG. 10D illustrates in cross section view the position of the rear revolving valve half a revolution from the home position, relative to the compressed gas slot in the main housing of FIGS. 5A and 5B.

As rear revolving valve 2 turns about its axis, a paintball resting in the front chamber scoop 1 is loaded to be discharged. The home position 126 for movement of the valve (marked on the IR sensor disc 124) corresponds to an open breech position where the scoop 1 faces upward towards breech opening 511 and thence towards the hopper, so that the scoop is ready for the next paintball to drop into it (FIG. 10A). When the revolving valve 2 and seals 122 are in the home position, air entrance slot 123 faces opposite to slot 520 in the main housing, so that compressed gas does not escape from reservoir 502 (FIG. 10B). After half a revolution (that is, after 25 milliseconds at a speed of 20 rps), scoop 1 faces downward, thereby sealing off the breech opening 511 (FIG. 10C). The two longitudinal round seals 122 are an appropriate angular distance apart (30° in this embodiment); as the valve turns and seals 122 sweep past slot 520, compressed gas form reservoir 502 is allowed to enter through the air entrance slot 123 (FIG. 10D). This compressed gas exits through the air exit hole 121 with an appropriate dwell time depending on the angular velocity and angular separation of the longitudinal round seals. For example, if the valve turns at 20 revolutions per second (so that one period is 50 milliseconds) and the seals are 30° apart, the dwell time is approximately 4 milliseconds. Accordingly, for about 4 milliseconds during each period, compressed gas escapes from the reservoir and enters the interior of the valve body in a radial direction through slot 123; the compressed gas then escapes from the valve body in an axial direction through exit hole 121 to propel the paintball.

Alternatively, other revolving valve designs may include the use of a removable O-ring or O-rings (See FIG. 8) to achieve the same purpose as detailed before.

Figure 3B:
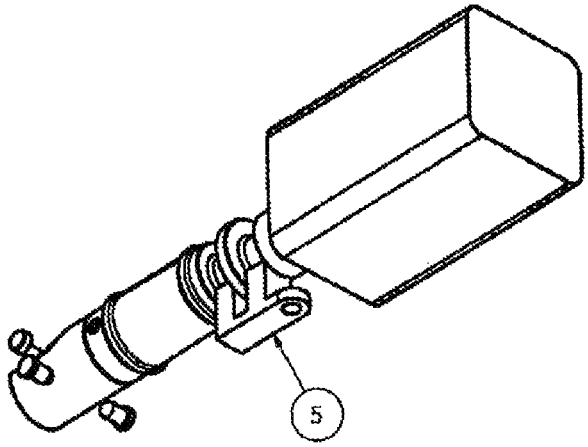
Figure 3C:
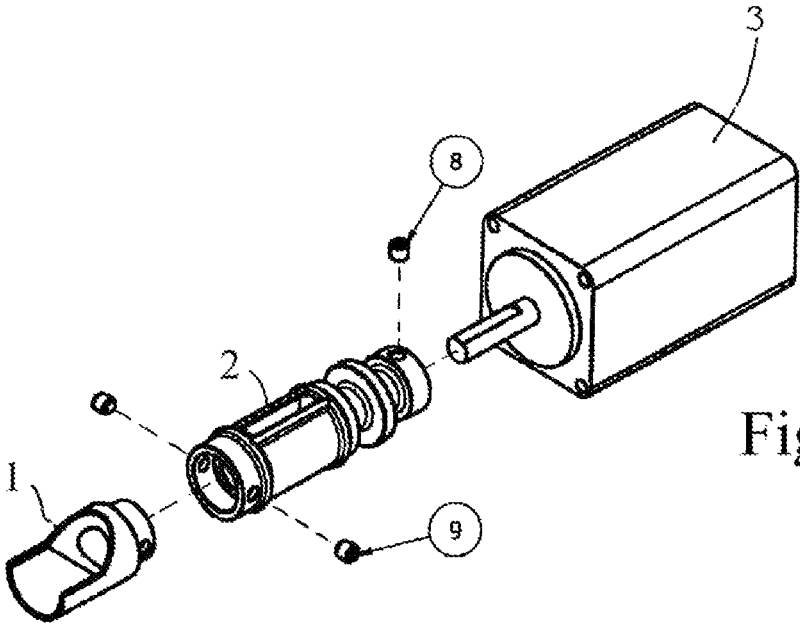
Figure 9:
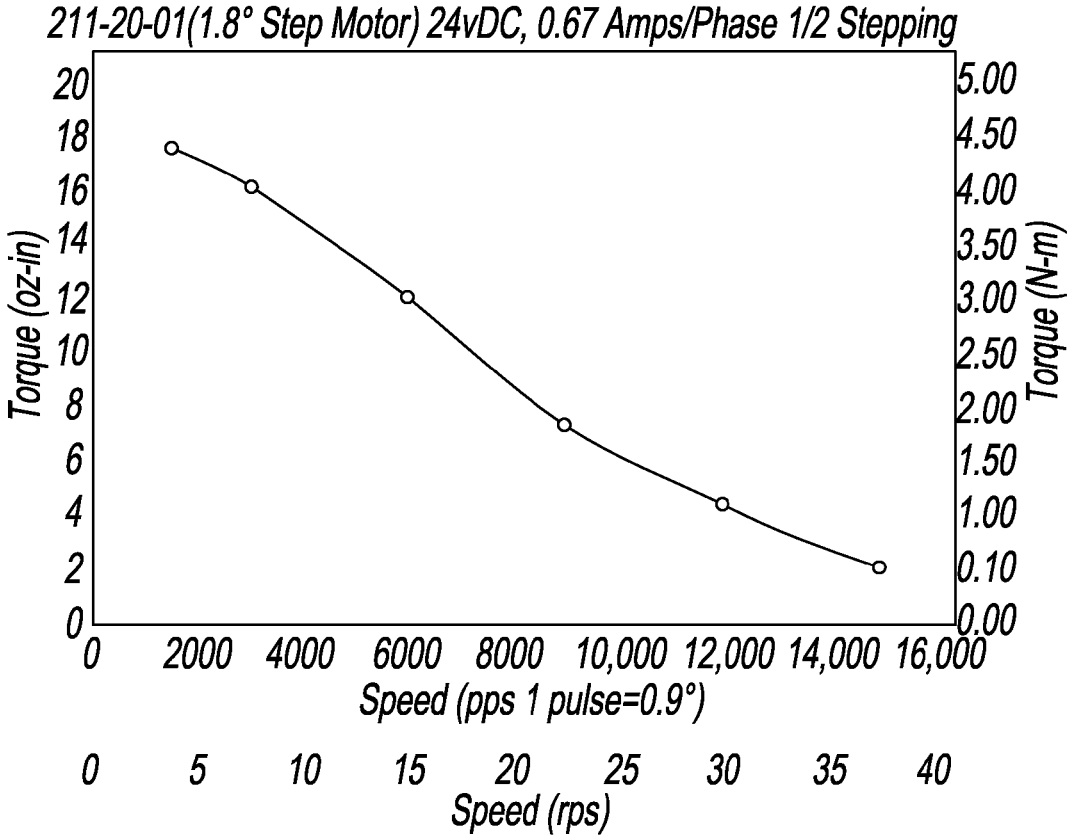
FIG. 9 illustrates the torque curve for a small-sized bipolar stepper motor used in embodiments of the disclosure.

Motor:

As shown in FIGS. 3A-3C, motor 3 drives revolving valve 2, with the motor shaft received in motor shaft hole 125 at the rear of the valve body (see FIG. 4D). In this embodiment, motor 3 is a motor, which can be precisely controlled to an accurate starting and stopping position. The motor shaft inserts into motor shaft hole 125 and is locked into place by motor shaft screw 8 (FIG. 3C). Appropriately sized motors supply approximately 6 to 50 oz-in of torque output and are typically controlled with the use of a driver and microprocessor with multiple I/O commands or if a DC motor sometimes through a home position. FIG. 9 shows a torque curve for a stepper motor that may be used in this embodiment. The motor with the torque curve in FIG. 9 can provide approximately 9 oz-in of torque at a speed of 20 revolutions per second. A stepper motor and DC motor are interchangeable for the purpose of rotating the valve assembly.

In other embodiments, a gear train may be used to adjust the desirable torque or speed output to the revolving valve. Other electronically driven, air-assisted, or manual rotational devices and mechanisms for turning the revolving valve may also be used.

Paintball:

As noted above, paintball 4 rests in the front revolving chamber scoop 1 before being discharge by the compressed gas exiting from the rear revolving valve 2. Current popular paintball sizes are .5 CAL and .68 CAL. Paintball 4 typically requires 150 to 300 psi of compressed gas to be propelled so as to achieve a muzzle velocity of 300 FPS (feet per second). The pressure required to obtain a desired muzzle velocity depends on the size and weight of the paintball.

IR Photosensor:

In this embodiment, an IR photosensor 5 (see FIG. 3B) provides feedback for the circuitry of the motor controller. As shown in FIG. 3B, the IR photosensor tracks the angular position of disc 124 and thus provides a "home position" signal to the controller. The home position 126 for revolution of the valve 2 is marked approximately one revolution from start to stop on the IR sensor disc 124. The front revolving chamber scoop 1 is open to feed a paintball in this position.

Ball Detent:

Ball detent 6, typically rubber in material, is located at the interior wall of main housing 10 (the wall of the cylindrical chamber 510 in which the revolving valve assembly turns), protruding radially inward toward the front revolving chamber scoop. Ball detent 6 holds the paintball in place while the revolving valve 2 is at rest. As the revolving chamber turns, the front revolving chamber scoop pushes the ball detent beneath itself, so that the paintball is free to exit the breech when pushed by air escaping from air exit hole 121.

Electronic Breakbeam Eye:

One or more electronic breakbeam eyes 7 monitor and sense the position of the paintball 4 (scoop 1 is made of a transparent material for this reason). The electronic breakbeam eyes determine whether the paintball is in the correct position to be discharged. If the paintball is not properly positioned, the electromagnetic beam is not broken; the circuit board detects a signal accordingly and the operation of the paintball marker will halt. The electronic breakbeam eyes are used to prevent the paintball marker from operating prematurely and decrease the chance of the paintball breaking inside the breech due to premature firing.

Main Housing Breech and Gas Reservoir:

FIG. 5A is a cutaway view of the main housing 10. FIG. 5B is a cross section view of the main housing 10, showing two parallel chambers having openings 461, 451 in the front face of the main housing. The upper chamber 510 is cylindrical and receives the revolving valve assembly through a rear opening 515; the valve assembly, driven by motor 3, turns inside chamber 510. A breech portion 501 has the front revolving chamber scoop 1 turning therein; paintballs from the hopper enter the breech through opening 511. The lower bore (in this embodiment, a second cylindrical chamber) comprises compressed gas reservoir 502. Reservoir 502 is plugged at the front end by front hole plug screw 45 (see FIG. 7). Opening 503 receives the outlet of a gas regulator which supplies compressed gas to the reservoir. The cylindrical chambers communicate through a slot 520 which is blocked by the revolving valve 2 and the round seals 122, except when in alignment with air entrance slot 123 of the revolving valve 2 (see FIG. 10D).

FIGS. 10A-10D illustrate opening and closing of the breech opening 511 and slot 520 during one revolution of the valve assembly. FIGS. 10A and 10C are cross sections of the chamber at breech 501, while FIGS. 10B and 10D are cross sections of the chamber at slot 520. As noted above, FIGS. 10A and 10B illustrate the home position of the revolving valve assembly, while FIGS. 10C and 10D illustrate the position of the revolving valve assembly half a revolution removed from the home position.

Paintball Marker: Assembled View

Figure 6A:
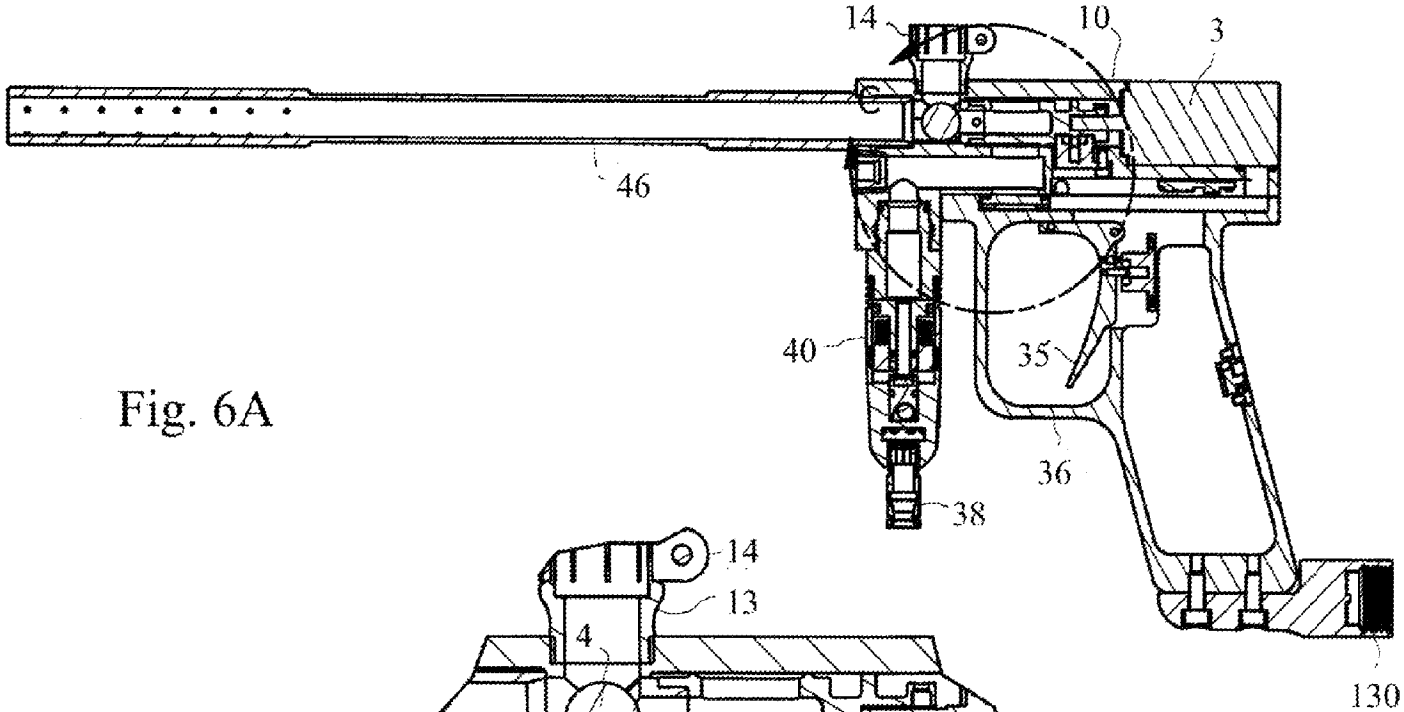
FIG. 6A is a cross section of an assembled paintball marker according to an embodiment of the disclosure.
Figure 6B:
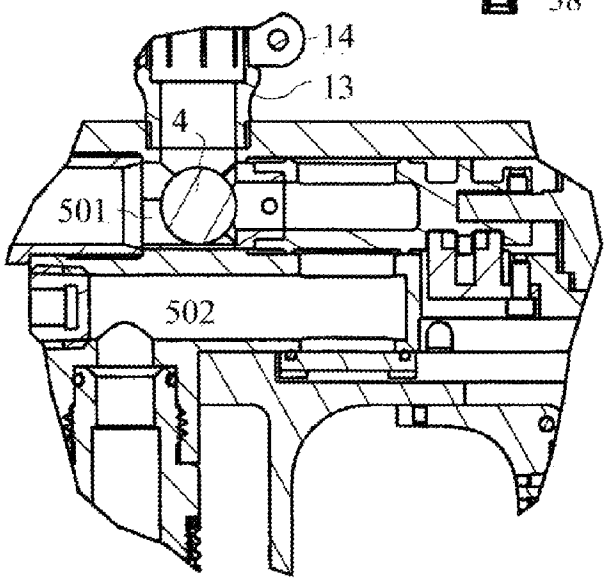
FIG. 6B is a detail view of FIG. 6A, showing the interior of the main housing with a paintball loaded in the breech thereof.

FIG. 6A is a cross section view of an assembled paintball marker in accordance with an embodiment of the disclosure. Paintball 4 (see detail in FIG. 6B) is shown at rest in the breech 501, ready to be propelled down barrel 46. Feedneck clamp 14 fastens and secures the paintball hopper (not shown) to feedneck 13 connecting to main housing 10. Air Source Adapter (ASA) regulator 40, connecting to reservoir 502, regulates input pressure from the compressed gas tank (not shown) and outputs an adjusted pressure into reservoir 502. The input of regulator 40 is connected to straight air connector 38, which in turn connects to a gas tube (not shown) leading to the air source adapter having coupler 130 connecting to the gas tank. It will be appreciated that the mechanism for propelling the paintball has only one moving part, namely the revolving valve assembly driven by the motor 3. Furthermore, all of the gas pressure from the regulator 40 supplied to reservoir 502 is expended in propelling the paintball; no gas is diverted to operating any mechanism.

Figure 7:
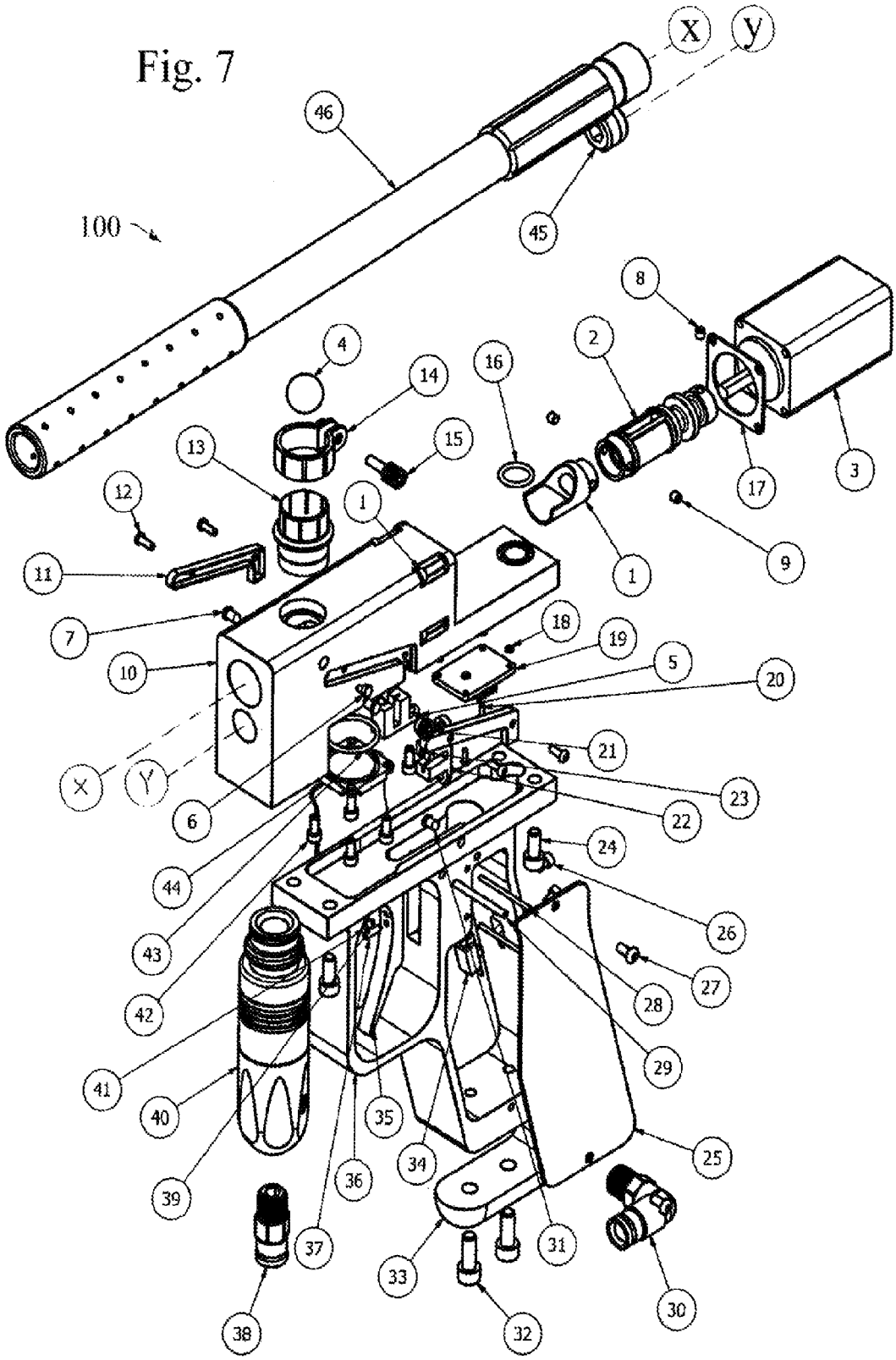
FIG. 7 is an exploded view of the paintball marker of FIG. 6.
Figure 8A:
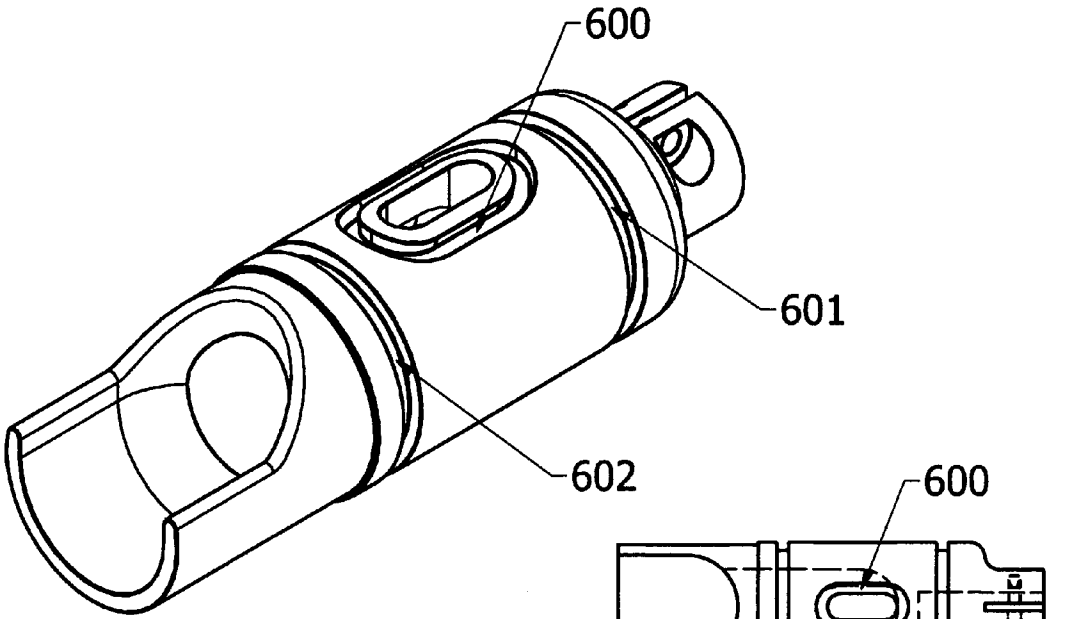
FIG. 8A is an isometric view.
Figure 8D:
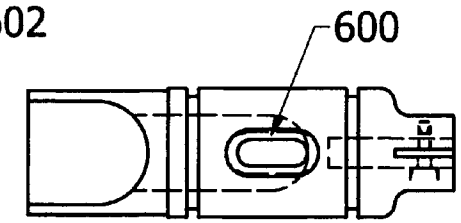
FIGS. 8B-D is front, right, and top views respectively.
Figure 8C:
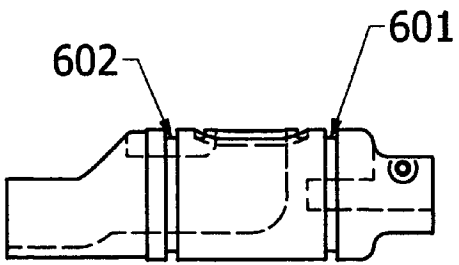
Figure 8B:
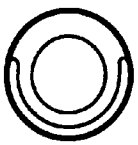

Paintball Marker: Exploded View:

Other components of the paintball marker in this embodiment are shown in FIG. 7.

Eye covers 11 protect the electronic breakbeam eyes from debris and UV radiation. Eye cover screws 12 attach the eye covers 11 to the main housing 10.

Feedneck clamp screw 15 adjusts the tightness of the feedneck clamp 14.

O-ring 16 seals the trigger frame compartment and protects the electronics from harmful saturation exposure. Motor damper 17 reduces vibration from the motor 3. Circuit board dampers 18 protect circuit board 19. Circuit board 19 operates motor 3. Circuit board screws 20 attach circuit board 19 to main housing 10. Ball detent cover screw 21 secures ball detent 6 in position.

Trigger switch 22, which in this embodiment comprises an IR sensor, activates the firing operation. The firing operation is initiated when trigger adjustment screw 37 on trigger 35 interrupts the switch. Trigger switch 22 rests behind the trigger. Trigger switch magnet 23 and trigger magnet 39 use magnetic repulsion to return trigger 35 to a safe, non-firing position. Trigger frame screws 24 attach trigger frame 36 to main housing 10.

Grip covers 25 protect the batteries stored in the grip frame compartment of the trigger frame. Grip covers 25 also provide a secure gripping surface for the user. On/Off switch screw 26 attaches On/Off switch 34 to trigger frame 36. Grip cover screws 27 attach grip covers 25 to trigger frame 36.

Trigger switch dowel pins 28 secure trigger switch 22 inside the trigger frame. Trigger dowel pin 29 acts as a pivot to trigger 35 and secures it in a swivel position in the trigger frame.

90° air swivel 30 connects an external air tube to straight air connector 38 and routes compressed gas from the air source adapter 33 to ASA regulator 40. ASA screws 32 attach the air source adapter 33 to the bottom of trigger frame 36.

On/Off LED light 31 lights up to indicate whether the marker is on or off. This light thus functions as a firing and safety mode indicator. On/Off switch 34 turns the paintball marker on and off, and also acts as a safety switch. Trigger adjustment screw 37 is adjusted to interrupt trigger switch 22 at a desired firing location during a trigger pull. Trigger adjustment screw 41 adjusts the magnetic repulsion length or trigger return length between the trigger frame magnet and the trigger magnet.

Air slot cover plate 44 compresses air slot cover plate O-ring 43 to seal the main housing reservoir. Air slot cover plate screws 42 attach the air slot cover plate to the main housing.

A paintball marker embodying the disclosure offers some significant benefits. Since there is only one moving part (the revolving valve assembly), there are no parts moving linearly or reciprocating. There are no mechanical switches or levers. The paintball is at rest when it is fired. Compressed gas is only used to propel a paintball, not to operate the firing mechanism. By adjusting the speed of the revolving valve, it is possible to achieve a desired dwell time, without relying on the timing of an air solenoid or mechanical parts. Also, there is no valve return travel leading to wasted air. A smaller compressed air tank may be used. This will lighten the overall load on the player.

The simplicity of operation, owing to a single moving part, ensures a high level of reliability. Furthermore, no intense lubrication is necessary, and no springs or large arrays of O-rings are required. Since there is no force from an internal loading mechanism on the paintballs while loading them into the breech, there is less likelihood of paintball breakage.

A paintball marker according to an embodiment of the disclosure may be lightweight and have a compact body design due to the single-part operation. In addition, the components are relatively inexpensive to produce, especially when considering the manufacturing technique of injection molding for the rotating assembly.

While the disclosure has been described in terms of specific embodiments, it is evident in view of the foregoing description that numerous alternatives, modifications and variations will be apparent to those skilled in the art. Accordingly, the disclosure is intended to encompass all such alternatives, modifications and variations which fall within the scope and spirit of the disclosure and the following claims.

What is claimed is:

1. A paintball marker comprising:

a housing having formed therein a cylindrical chamber with an axis, the chamber having an open end and a wall, the wall having therein a first opening and a second opening; and a valve assembly within the chamber and coaxial therewith, the valve assembly configured so that, during one period of revolution about the axis:

in a first portion of the period of revolution, the valve assembly closes the second opening while permitting entry of a ball into the chamber through the first opening, and in a second portion of the period of revolution, the valve assembly closes the first opening while permitting entry of compressed gas into the chamber through the second opening, the compressed gas entering the chamber during the second portion of the period of revolution being effective to expel the ball through the open end of the chamber;

wherein the valve assembly comprises a valve body having an axial slot therein for permitting entry of the compressed gas in the second portion of the period of revolution, the slot having sides extending in the axial direction and ends extending in the azimuthal direction, and the valve body has protrusions at an exterior cylindrical surface thereof for contacting an inner surface of the chamber and thereby preventing escape of the compressed gas at the exterior of the valve, the protrusions forming axially spaced circumferential seals at respective ends of the slot and longitudinal seals, each intersecting said circumferential seals, along respective sides of the slot.

2. A paintball marker according to claim 1, wherein the valve assembly further comprises a scoop for holding the ball, the scoop being attached to the valve body and coaxial therewith, the scoop being configured to receive the ball entering the chamber in the first portion of the period and to close the first opening in the second portion of the period, the scoop being open at a front end thereof to permit movement of the ball as it is expelled and having an opening at a rear end thereof to communicate with an interior of the valve body, so that the compressed gas flows through said opening toward the ball in the second portion of the period.

3. A paintball marker according to claim 2, wherein the scoop is formed of a transparent material.

4. A paintball marker according to claim 2, further comprising a ball detent protruding radially inward from the wall of the chamber toward the scoop, for preventing movement of the ball while the valve assembly is at rest relative to the chamber.

5. A paintball marker according to claim 3, further comprising one or more electronic breakbeam eyes for monitoring and for sensing the position of the ball.

6. A paintball marker according to claim 2, wherein the chamber includes a breech portion communicating with the first opening, into which the ball drops by gravity in the first portion of the period, the breech portion having the scoop disposed therein so that the ball drops into the scoop.

7. A paintball marker according to claim 6, further comprising a hopper, coupled to the breech portion via the first opening, for holding the ball prior to dropping into the breech portion.

8. A paintball marker according to claim 1, wherein a time during the period of revolution which the slot is at least partially aligned with the second opening is characterized as a dwell time for flow of the compressed gas into the chamber and thence toward the ball.

9. A paintball marker according to claim 1, wherein the valve body is formed from polytetrafluoroethylene (PTFE).

10. A paintball marker comprising:

a housing having formed therein a cylindrical chamber with an axis, the chamber having an open end and a wall, the wall having therein a first opening and a second opening;

a valve assembly within the chamber and coaxial therewith, the valve assembly configured so that, during one period of revolution about the axis:

in a first portion of the period of revolution, the valve assembly closes the second opening while permitting entry of a ball into the chamber through the first opening, and in a second portion of the period of revolution, the valve assembly closes the first opening while permitting entry of compressed gas into the chamber through the second opening, the compressed gas entering the chamber during the second portion of the period of revolution being effective to expel the ball through the open end of the chamber; and a compressed gas reservoir formed in the housing and communicating with the chamber via a compressed gas slot, the chamber having an additional opening for coupling to a source of compressed gas.

11. A paintball marker according to claim 10, further comprising a regulator coupled to the reservoir at said additional opening for conducting compressed gas to the reservoir.

12. A paintball marker comprising:

a housing having formed therein a cylindrical chamber with an axis, the chamber having an open end and a wall, the wall having therein a first opening and a second opening;

a valve assembly within the chamber and coaxial therewith, the valve assembly configured so that, during one period of revolution about the axis:

in a first portion of the period of revolution, the valve assembly closes the second opening while permitting entry of a ball into the chamber through the first opening, and in a second portion of the period of revolution, the valve assembly closes the first opening while permitting entry of compressed gas into the chamber through the second opening, the compressed gas entering the chamber during the second portion of the period of revolution being effective to expel the ball through the open end of the chamber; and a motor having a motor shaft coupled to the valve assembly for causing the revolution of the valve assembly about the axis.

13. A paintball marker according to claim 12, wherein the motor comprises a stepper motor.

14. A paintball marker according to claim 13, wherein the stepper motor provides a torque in accordance with a radial interference between the circumferential seals and the wall of the cylindrical chamber.

15. A paintball marker according to claim 13, wherein the stepper motor provides at least 8 oz-in of torque at a speed of 20 revolutions per second, and the compressed gas has a pressure of approximately 260 psi.

16. A paintball marker according to claim 12, further comprising a sensor for sensing the position of the valve assembly during revolution about the axis.

17. A paintball marker according to claim 9, further comprising a trigger, a trigger switch, and a motor controller coupled to the motor, the trigger switch connected to the motor controller and the trigger so that a signal to the motor to cause movement of the valve assembly is generated in accordance with interruption of the trigger switch caused by movement of the trigger.

18. A paintball marker according to claim 17, wherein the trigger switch comprises an IR sensor.

19. The paintball marker according to claim 12, wherein:

the valve assembly comprises a revolving valve configured to seal compressed gas while at rest; and/or the valve assembly comprises a revolving valve configured to seal and release compressed gas while in motion; and/or the ball is discharged solely with the revolving operation of the valve assembly; and/or the valve assembly is operated by an assisted rotational device; and/or the valve assembly comprises a revolving valve with a start and stop position located one revolution from initial movement.

20. A paintball marker comprising:

a housing having formed therein a cylindrical chamber with an axis, the chamber having an open end and a wall, the wall having therein a first opening and a second opening;

a valve assembly within the chamber and coaxial therewith, the valve assembly configured so that, during one period of revolution about the axis:

in a first portion of the period of revolution, the valve assembly closes the second opening while permitting entry of a ball into the chamber through the first opening, and in a second portion of the period of revolution, the valve assembly closes the first opening while permitting entry of compressed gas into the chamber through the second opening, the compressed gas entering the chamber during the second portion of the period of revolution being effective to expel the ball through the open end of the chamber;

an IR photosensor for sensing the position of the valve assembly during revolution about the axis; and a disc coaxial with the valve assembly, the disc having a home position for the valve assembly marked thereon.

* * * * *